US008470416B2

(12) United States Patent
Simpson et al.

(10) Patent No.: US 8,470,416 B2
(45) Date of Patent: Jun. 25, 2013

(54) TRANSPARENT INK-JET RECORDING FILMS, COMPOSITIONS, AND METHODS

(75) Inventors: Sharon M. Simpson, Lake Elmo, MN (US); James B. Philip, Mahtomedi, MN (US)

(73) Assignee: Carestream Health, Inc., Rochester, NY (US)

( * ) Notice: Subject to any disclaimer, the term of this patent is extended or adjusted under 35 U.S.C. 154(b) by 0 days.

(21) Appl. No.: 13/290,185

(22) Filed: Nov. 7, 2011

(65) Prior Publication Data

US 2012/0121828 A1 May 17, 2012

Related U.S. Application Data

(60) Provisional application No. 61/412,839, filed on Nov. 21, 2010.

(51) Int. Cl.
*B41M 5/00* (2006.01)
*B41M 5/52* (2006.01)
*B41M 5/50* (2006.01)

(52) U.S. Cl.
CPC ..... *B41M 5/52* (2013.01); *B41M 5/5254* (2013.01); *B41M 5/506* (2013.01); *B41M 5/5218* (2013.01); *B41M 5/5236* (2013.01)
USPC ..... 428/32.13; 428/32.24; 428/32.25; 428/32.26; 428/32.27; 428/32.28; 428/32.34

(58) Field of Classification Search
CPC .... B41M 5/0256; B41M 5/5254; B41M 5/506; B41M 5/5218; B41M 5/502; B41M 5/508
USPC ..... 428/32.13, 32.24, 32.25, 32.26, 32.27, 428/32.28, 32.34

See application file for complete search history.

(56) References Cited

U.S. PATENT DOCUMENTS

| | | | | |
|---|---|---|---|---|
| 4,365,423 | A | 12/1982 | Arter et al. | |
| 5,795,708 | A | 8/1998 | Boutet | |
| 6,387,473 | B1 * | 5/2002 | Sismondi et al. | 428/32.34 |
| 6,623,819 | B2 | 9/2003 | Missell et al. | |
| 6,630,283 | B1 | 10/2003 | Simpson et al. | |
| 6,908,191 | B2 | 6/2005 | Liu et al. | |
| 2002/0182380 | A1 | 12/2002 | Nagashima et al. | |
| 2003/0064208 | A1 * | 4/2003 | Yamada et al. | 428/195 |
| 2008/0057232 | A1 * | 3/2008 | Leon et al. | 428/32.24 |

FOREIGN PATENT DOCUMENTS

EP 1 346 840 A1 9/2003

OTHER PUBLICATIONS

Research Disclosure 308119, Dec. 1989, 46 pages.
Commonly assigned U.S. Appl. No. 13/176,788, entitled: Transparent Ink-Jet Recording Film, filed Jul. 6, 2011, by Simpson et al.
Commonly assigned U.S. Appl. No. 13/208,379, entitled: Transparent Ink-Jet Recording Films, Compositions, and Methods, filed Aug. 12, 2011, by Simpson et al.
Commonly assigned U.S. Appl. No. 13/247,135 entitled: Transparent Ink-Jet Recording Films, Compositions, and Methods, filed Sep. 28, 2011, by Simpson et al.
International Search Report dated Dec. 21, 2011 for International Application No. PCT/US2011/059666, 2 pages.

* cited by examiner

*Primary Examiner* — Betelhem Shewareged
(74) *Attorney, Agent, or Firm* — Reed L. Christiansen

(57) ABSTRACT

Transparent ink-jet recording films, compositions, and methods are disclosed. Such films do not exhibit excessive ink drying times. These films can be free of such visual effects as mud cracking. These films are useful for medical imaging.

13 Claims, No Drawings

TRANSPARENT INK-JET RECORDING FILMS, COMPOSITIONS, AND METHODS

CROSS REFERENCE TO RELATED APPLICATIONS

This application claims the benefit of U.S. Provisional Application No. 61/412,839, filed Nov. 12, 2010, entitled TRANSPARENT INK-JET RECORDING FILMS, COMPOSITIONS, AND METHODS, which is hereby incorporated by reference in its entirety.

SUMMARY

Transparent ink-jet recording films often employ one or more image-receiving layers on one or both sides of a transparent support. In order to obtain high image densities when printing on transparent films, more ink is often applied than is required for opaque films. However, use of more ink can increase ink drying times, impacting ink-jet printer throughput. The compositions and methods of the present application can provide transparent ink-jet recording films that do not exhibit excessive ink drying times. Such films can be free of such visual defects as mud cracking.

U.S. Pat. No. 6,908,191 to Liu et al., which is hereby incorporated by reference in its entirety, discloses and claims methods employing ink-jet media comprising subbing layers based on sulfonated polyester binders. Liu et al. disclose that ink-jet media employing subbing layers comprising a sulfonated polyester binder (EASTMAN AQ29®, Eastman Chemical) exhibit better performance than those employing subbing layers comprising a poly(vinyl alcohol) binder. Surprisingly, Applicants have discovered that ink-jet media employing under-layers comprising poly(vinyl alcohol) can perform better than similar ink-jet media employing under-layers comprising sulfonated polyesters.

U.S. Pat. No. 6,623,819 to Missell et al., which is hereby incorporated by reference in its entirety, discloses and claims ink-jet media comprising subbing layers comprising 3 to 50 $g/m^2$ of a borate or borate derivative. Missell et al. disclose that use of lower levels of borate exhibit poor drying and cracking performance. Surprisingly, Applicants have discovered that ink-jet media employing under-layers comprising borates or borate derivatives with dry coverages below 3 $g/m^2$ can exhibit superior drying and cracking performance.

At least one embodiment provides a transparent ink-jet recording film comprising a substrate; at least one under-layer disposed on the substrate, where the at least one under-layer comprises at least one borate or borate derivative and at least one first water soluble or water dispersible polymer comprising at least one hydroxyl group; and at least one image-receiving layer disposed on the at least one under-layer, where the at least one image-receiving layer comprises at least one inorganic particle and at least one second water soluble or water dispersible polymer comprising at least one hydroxyl group, wherein the at least one under-layer has a borate or borate derivative coverage greater than about $2.01\times10^{-12}$ $m^{12}/g^6$ times the seventh power of said image-receiving layer coating weight and less than about 3 $g/m^2$. In some cases, the under-layer may have a borate or borate derivative coverage of less than about 2 $g/m^2$.

In at least some embodiments, the at least one borate or borate derivative comprises at least one hydrate of sodium tetraborate, such as, for example, sodium tetraborate decahydrate. In at least some embodiments either the at least one first water dispersible or water soluble polymer comprises poly (vinyl alcohol), or the at least one second water dispersible or water soluble polymer comprises poly(vinyl alcohol), or both comprise poly(vinyl alcohol). In at least some embodiments, the at least one inorganic particle comprises boehmite alumina. The image-receiving layer may, in some embodiments, further comprise nitric acid.

In some cases, the image-receiving layer coating weight can be less than about 54.8 $g/m^2$. In at least some embodiments, the image receiving layer coating weight may be, for example, about 41.5 $g/m^2$ and the at least one under-layer has a borate or borate derivative coverage of at least about 0.427 $g/m^2$, or the image layer coating weight may be, for example, about 45.1 $g/m^2$ and the at least one under-layer has a borate or borate derivative coverage of at least about 0.992 $g/m^2$.

In at least some embodiments, the borate or borate derivative coverage may be, for example, at least about $2.61\times10^{-12}$ $m^{12}/g^6$ times the seventh power of said image-receiving layer coating weight. In such a case, the image receiving layer coating weight may, for example, be less than about 52.8 $g/m^2$.

These embodiments and other variations and modifications may be better understood from the detailed description, exemplary embodiments, examples, and claims that follow. Any embodiments provided are given only by way of illustrative example. Other desirable objectives and advantages inherently achieved may occur or become apparent to those skilled in the art. The invention is defined by the appended claims.

DETAILED DESCRIPTION

All publications, patents, and patent documents referred to in this document are incorporated by reference herein in their entirety, as though individually incorporated by reference.

U.S. Provisional Application No. 61/412,839, filed Nov. 12, 2010, entitled TRANSPARENT INK-JET RECORDING FILMS, COMPOSITIONS, AND METHODS, is hereby incorporated by reference in its entirety.

Introduction

An ink-jet recording film may comprise at least one image-receiving layer, which receives ink from an ink-jet printer during printing, and a substrate or support, which may be opaque or transparent. An opaque support may be used in films that may be viewed using light reflected by a reflective backing, while a transparent support may be used in films that may be viewed using light transmitted through the film.

Some medical imaging applications require high image densities. For a reflective film, high image densities may be achieved by virtue of the light being absorbed on both its path into the imaged film and again on the light's path back out of the imaged film from the reflective backing. On the other hand, for a transparent film, because of the lack of a reflective backing, achievement of high image densities may require application of larger quantities of ink than are common for opaque films.

Transparent Ink-Jet Films

Transparent ink-jet recording films are known in the art. See, for example, U.S. patent application Ser. No. 13/176,788, "TRANSPARENT INK-JET RECORDING FILM," by Simpson et al., filed Jul. 6, 2011, and U.S. patent application Ser. No. 13/208,379, "TRANSPARENT INK-JET RECORDING FILMS, COMPOSITIONS, AND METHODS," by Simpson et al., filed Aug. 12, 2011, both of which are herein incorporated by reference in their entirety.

Transparent ink-jet recording films may comprise one or more transparent substrates upon which at least one under-layer may be coated. Such an under-layer may optionally be dried before being further processed. The film may further comprise one or more image-receiving layers coated upon at least one under-layer. Such an image-receiving layer is generally dried after coating. The film may optionally further comprise additional layers, such as one or more backing layers or overcoat layers, as will be understood by those skilled in the art.

A performance characteristic of transparent ink-jet recording films is the presence or absence of "mud cracking." A film that exhibits mud cracking has a surface with fine cracks that resemble a dry creek bed. Such mud-cracking on a film's surface can impact the quality of the rendered image. An observer may qualitatively assess the visual severity of mud-cracking exhibited by transparent ink-jet films, so their relative quality may be ranked.

Under-Layer Coating Mix

Under-layers may be formed by applying at least one under-layer coating mix to one or more transparent substrates. The under-layer coating mix may comprise at least one first water soluble or water dispersible polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the water soluble or water dispersible polymer may be used in an amount from about 0.25 to about 2.0 g/m$^2$, or from about 0.02 to about 1.8 g/m$^2$, as measured in the under-layer.

The under-layer coating mix may further comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to, for example, about 2 g/m$^2$, or up to, for example, about 3 g/m$^2$, on a dry basis. In some embodiments, the ratio of the at least one borate or borate derivative to the at least one first water soluble or water dispersible polymer may be, for example, between about 25:75 and about 90:10 by weight, or the ratio may be, for example, about 66:33 by weight.

The under-layer coating mix may also optionally comprise other components, such as surfactants, such as, for example, nonyl phenol, glycidyl polyether. In some embodiments, such a surfactant may be used in amount from about 0.001 to about 0.10 g/m$^2$, as measured in the under-layer. These and other optional mix components will be understood by those skilled in the art.

Image-Receiving Layer Coating Mix

Image-receiving layers may be formed by applying at least one image-receiving layer coating mix to one or more under-layer coatings. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the image-receiving layer coating mix. In some embodiments, the at least one water soluble or water dispersible polymer may be used in an amount of up to about 1.0 to about 4.5 g/m$^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or the ratio may be, for example, about 92:8 by weight.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73. During preparation, such alumina mixes may optionally be heated, for example, to 80° C.

The image-receiving coating layer mix may also comprise one or more surfactants such as, for example, nonyl phenol, glycidyl polyether. In some embodiments, such a surfactant may be used in amount of, for example, about 1.5 g/m$^2$, as measured in the image-receiving layer. In some embodiments, the image-receiving coating layer may also optionally comprise one or more acids, such as, for example, nitric acid.

These and components may optionally be included in the image-receiving coating layer mix, as will be understood by those skilled in the art.

Transparent Substrate

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications.

These and other components may optionally be included in the transparent substrate, as will be understood by those skilled in the art.

In some embodiments, the transparent substrate may be provided as a continuous or semi-continuous web, which travels past the various coating, drying, and cutting stations in a continuous or semi-continuous process.

Coating

The at least one under-layer and at least one image-receiving layer may be coated from mixes onto the transparent substrate. The various mixes may use the same or different solvents, such as, for example, water or organic solvents. Layers may be coated one at a time, or two or more layers may be coated simultaneously. For example, simultaneously with application of an under-layer coating mix to the support, an image-receiving layer may be applied to the wet under-layer using such methods as, for example, slide coating.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure*, No. 308119, Dec. 1989, pp. 1007 08, (available from Research Disclosure, 145 Main St., Ossining, NY, 10562, http://www.researchdisclosure.com).

Drying

Coated layers, such as, for example under-layers or image-receiving layers, may be dried using a variety of known methods. Examples of some drying methods are described in, for example, *Research Disclosure*, No. 308119, December 1989, pp. 1007-08, (available from Research Disclosure, 145 Main St., Ossining, N.Y., 10562, http://www.researchdisclosure-.com). In some embodiments, coating layers may be dried as they travel past one or more perforated plates through which a gas, such as, for example, air or nitrogen, passes. Such an impingement air dryer is described in U.S. Pat. No. 4,365,423 to Arter et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water may be limited by its dew point, while its ability to remove organic solvents may be limited by the amount of such solvents in the gas, as will be understood by those skilled in the art.

In some embodiments, the under-layer may be dried by exposure to ambient air. Image-receiving layers may be dried by exposure to air at, for example, 85° C. for 10 min in a Blue M Oven.

Film Visual Defects and Borate/Borate Derivative Coverage

Visual defects can impact the ability of transparent ink-jet films to provide high fidelity representations of medical imaging data. Such visual defects may include, for example, "mud cracking"—cracks in the image-receptor layer of the coated film reminiscent of the surface of a dried creek bed. While not wishing to be bound by theory, it is believed that at least some visual defects may be caused by stresses developed during the drying stages of the film fabrication process.

It has been discovered that mud cracking may be diminished or eliminated by providing sufficient borate or borate derivative coverage in the at least one under-layer of the film, according to the dry coating weight of the at least one image-receiving layer of the film. In particular, the parameter:

$$\alpha = \frac{\text{Under-Layer Borate or Borate Derivative Coverage, g/m}^2}{(\text{Image-Receiving Layer Coating Weight, g/m}^2)^7}$$

has been found to characterize the propensity for development of mud cracking. In some embodiments, $\alpha$ may be, for example, at least about $2.01\times10^{-12}$ $m^{12}/g^6$, or at least about $2.61\times10^{-12}$ $m^{12}/g^6$, to provide transparent ink-jet recording films that exhibit rapid ink drying rates with minimized development of mud cracking.

EXEMPLARY EMBODIMENTS

U.S. Provisional Application No. 61/412,839, filed Nov. 12, 2010, entitled TRANSPARENT INK-JET RECORDING FILMS, COMPOSITIONS, AND METHODS, which is hereby incorporated by reference in its entirety, disclosed the following nine non-limiting exemplary embodiments:

A. A transparent ink-jet recording film comprising:

a substrate;

at least one under-layer disposed on said substrate, said at least one under-layer comprising at least one borate or borate derivative and at least one first water soluble or water dispersible polymer comprising at least one hydroxyl group; and at least one image-receiving layer disposed on said at least one under-layer, said at least one image-receiving layer comprising at least one inorganic particle and at least one second water soluble or water dispersible polymer comprising at least one hydroxyl group, wherein said at least one image-receiving layer has an image-receiving layer coating weight, and further wherein said at least one under-layer has a borate or borate derivative coverage of at least about $2.01\times10^{-12}$ $m^{12}/g^6$ times the seventh power of said image-receiving layer coating weight.

B. The transparent ink-jet recording film according to embodiment A, wherein said at least one borate or borate derivative comprises at least one hydrate of sodium tetraborate.

C. The transparent ink-jet recording film according to embodiment A, wherein said at least one borate or borate derivative comprises sodium tetraborate decahydrate.

D. The transparent ink-jet recording film according to embodiment A, wherein said at least one first water soluble or water dispersible polymer comprises poly(vinyl alcohol).

E. The transparent ink-jet recording film according to embodiment A, wherein said at least one second water soluble or water dispersible polymer comprises poly(vinyl alcohol).

F. The transparent ink-jet recording film according to embodiment A, wherein said at least one inorganic particle comprises boehmite alumina.

G. The transparent ink-jet recording film according to embodiment A, wherein said image receiving layer coating weight is about 41.5 $g/m^2$ and the at least one under-layer has a borate or borate derivative coverage of at least about 0.427 $g/m^2$.

H. The transparent ink-jet recording film according to embodiment A, wherein said image receiving layer coating weight is about 45.1 $g/m^2$ and the at least one under-layer has a borate or borate derivative coverage of at least about 0.992 $g/m^2$.

J. The transparent ink-jet recording film according to embodiment A, wherein said borate or borate derivative coverage is at least about $2.61\times10^{-12}$ $m^{12}/g^6$ times the seventh power of said image-receiving layer coating weight.

EXAMPLES

Materials

Materials used in the examples were available from Aldrich Chemical Co., Milwaukee, unless otherwise specified.

Boehmite is an aluminum oxide hydroxide (γ-AlO(OH)).

Borax is sodium tetraborate decahydrate.

CELVOL® 203 is a poly(vinyl alcohol) that is 87-89% hydrolyzed, with 13,000-23,000 weight-average molecular weight. It is available from Specialty Chemicals America, Dallas, Tex.

CELVOL® 540 is a poly(vinyl alcohol) that is 87-89.9% hydrolyzed, with 140,000-186,000 weight-average molecular weight. It is available from Sekisui Specialty Chemicals America, LLC, Dallas, Tex.

DISPERAL® HP-14 is a dispersible boehmite alumina powder with high porosity and a particle size of 14 nm. It is available from Sasol North America, Inc., Houston, Tex.

EASTMAN AQ29® is an aqueous sulfonated polyester dispersion. It is available from Eastman Chemical Co., Kingsport, Tenn.

Surfactant 10G is an aqueous solution of nonyl phenol, glycidyl polyether. It is available from Dixie Chemical Co., Houston, Tex.

Example 1

A series of substrates were coated with under-layer coating mixes consisting of borax, poly(vinyl alcohol), and deionized water. The under-layer coatings were dried. Onto these under-layer coated substrates were coated image-receiving coating layer mixes consisting of boehmite alumina, poly(vinyl alcohol), and water, where the ratio of boehmite alumina to poly (vinyl alcohol) was 94:6 by weight. The image-receiving coating layers were dried. The resulting coated films were visually inspected for the presence of mud cracking.

Table I shows the compositions that were prepared and their mud cracking results. Also shown in the table is the parameter:

$$\alpha = \frac{\text{Under-Layer Borax Coverage, g/m}^2}{(\text{Image-Receiving Layer Coating Weight, g/m}^2)^7}$$

Coated films with parameter α less than about $2.61\times10^{-12}$ $m^{12}/g^6$ exhibited mud cracking, while coated films with parameter α at least about $2.61\times10^{-12}$ $m^{12}/g^6$ exhibited no mud cracking.

Example 2

Preparation of Under-Layer Coated Substrate

A nominal 15 wt % polymer solution was first made. 37.5 g of poly(vinyl alcohol) (CELVOL® 203, Sekisui) was added over ten minutes to 212.5 g of deionized water, which was agitated at room temperature. The agitated mixture was heated to 85° C. and held for 30 min. The agitated mix was cooled. After returning to room temperature, approximately 1.5 g of deionized water was added to make up for water lost to evaporation. This polymer solution was held for gas bubble disengagement prior to use.

A nominal 5 wt % borax solution was then made. 5.0 g of borax was added to 95 g of deionized water and sonicated at 47° C. This borax solution was held at 47° C. prior to use.

A sheet of polyethylene terephthalate was knife-coated with a mixture of 0.88 g of the polymer solution, 5.28 g of the borax solution, and 3.84 g of deionized water, using a wet coating gap of 2.5 mils. The resulting under-layer coating had 4 wt % solids and a weight ratio of borax to polymer of 66:33.

Preparation of Image-Receiving Layer Coated Film

A nominal 10 wt % polymer solution was prepared by adding over ten minutes 25 g of poly(vinyl alcohol) (CELVOL® 540, Sekisui) to 225 g of deionized water, which was agitated at room temperature. The agitated mixture was heated to 85° C. and held for 30 min. The agitated mixture was cooled. After returning to room temperature, approximately 1.5 g of deionized water was added to make up for water lost to evaporation. This polymer solution was held for gas bubble disengagement prior to use.

A nominal 20 wt % alumina mix was prepared at room temperature by adding 140 g of alumina powder (DISPERAL® HP-14, Sasol) to 560 g of deionized water with agitation over 30 min. The pH of the mix was adjusted to 3.25 by adding 40 drops of a 67 wt % aqueous solution of nitric acid. The mix was heated to 80° C. and stirred for 30 min. The mix was cooled. After returning to room temperature, approximately 1.0 g of deionized water was added to make up for water lost to evaporation. This alumina mix was held for gas bubble disengagement prior to use.

A nominal 17.9 wt % solids image-receiving coating mix was prepared at room temperature by introducing 7.13 g of the polymer solution into a mixing vessel and agitating. To this mix, 41.00 g of the alumina mix, and 1.66 g of deionized water were added. The resulting image-receiving layer coating mix had an inorganic particle to polymer weight ratio of 92:8.

The nominal 17.9 wt % solids image-receiving layer coating mix was knife-coated at room temperature onto the under-layer coated substrate, using a coating gap of 12 mils. The coated film was dried at 85° C. in a Blue M Oven.

Evaluation of Coated Film

The coated film was visually inspected for mud cracking or other visual flaws. Also shown in the table is the parameter:

$$\alpha = \frac{\text{Under-Layer Borax Coverage, g/m}^2}{(\text{Image-Receiving Layer Coating Weight, g/m}^2)^7}$$

The results of this inspection are shown in Table II.

The coated film was then imaged with an EPSON® 7900 ink-jet printer using a Wasatch Raster Image Processor (RIP). A grey scale image was created by a combination of photo black, light black, light light black, magenta, light magenta, cyan, light cyan, and yellow EPSON® inks that were supplied with the printer. Samples were printed with a 17-step grey scale wedge having a maximum optical density of at least 2.8.

Immediately after the film exited the printer, the ink-jet image was turned over and placed over a piece of white paper. The fraction of each wedge that was wet was recorded by sequential wedge number, with wedge 1 being the wedge having the maximum optical density and wedge 17 being the wedge with the minimum optical density. In general, the higher number wedges dried before the lowest number wedges.

A measure of wetness was constructed by taking the largest wedge number for the set of completely wet wedges and adding to it the fractional wetness of the adjacent wedge with the next higher wedge number. For example, if wedges 1 and 2 were completely wet and wedge 3 was 25% wet, the wetness value would be 2.25. Or if no wedges were completely wet, but wedge 1 was 75% wet, the wetness value would be 0.75. These results are also summarized in Table II.

Example 3

Preparation of Under-Layer Coated Substrate

An under-layer coated substrate was prepared according to the procedure of Example 2.

Preparation of Image-Receiving Layer Coated Film

A nominal 17.9% solids image-receiving coating mix was prepared at room temperature by introducing 7.13 of the CELVOL® 540 polymer solution of Example 2 into a mixing vessel and agitating. To this mix, 41.00 g of the alumina mix of Example 2, 0.66 g of a 10 wt % aqueous solution of Surfactant 10G and 1.00 g of deionized water were added. The resulting image-receiving layer coating mix had an inorganic particle to polymer weight ration of 92:8.

The nominal 17.9 wt % solids image-receiving layer coating mix was knife-coated at room temperature onto the under-layer coated substrate, using a coating gap of 12 mils. The coated film was dried at 85° C. in a Blue M Oven.

Evaluation of Coated Film

The coated film was evaluated according to the procedure of Example 2. Results of this evaluation are shown in Table II.

Example 4

Preparation of Under-Layer Coated Substrate

A sheet of polyethylene terephthalate was knife-coated with a mixture of 1.41 g of the CELVOL® 203 polymer solution of Example 2, 8.45 g of the borax solution, and 3.14 g of deionized water, using a wet coating gap of 4.0 mils. The resulting under-layer coating had 4 wt % solids and a weight ratio of borax to polymer of 66:33.

Preparation of Image-Receiving Layer Coated Film

An image-receiving layer coating mix was prepared according to the procedure of Example 3. This mix was knife-coated at room temperature onto the under-layer coated substrate, using a coating gap of 12 mils. The coated film was dried at 85° C. in a Blue M Oven.

Evaluation of Coated Film

The coated film was evaluated according to the procedure of Example 2. Results of this evaluation are shown in Table II.

Example 5

Example 2 was replicated. Results of the film evaluation are shown in Table II. All film samples in Table II that had a parameters of $2.01\times10^{-12}$ $m^{12}/g^{6}$ or larger exhibited no mud cracking.

Example 6

Example 3 was replicated. Results of the film evaluation are shown in Table II.

Example 7

Preparation of Under-Layer Coated Substrate

A sheet of polyethylene terephthalate was knife-coated with a mixture of 1.06 g of the CELVOL® 203 polymer solution of Example 2, 6.45 g of the borax solution, and 4.61 g of deionized water, using a wet coating gap of 3.0 mils. The resulting under-layer coating had 4 wt % solids and a weight ratio of borax to polymer of 66:33.

Preparation of Image-Receiving Layer Coated Film

An image-receiving layer coating mix was prepared according to the procedure of Example 3. This mix was knife-coated at room temperature onto the under-layer coated substrate, using a coating gap of 12 mils. The coated film was dried at 85° C. in a Blue M Oven.

Evaluation of Coated Film

The coated film was evaluated according to the procedure of Example 2. Results of this evaluation are shown in Table II.

Example 8

Preparation of Under-Layer Coated Substrate

A sheet of polyethylene terephthalate was knife-coated with a mixture of 1.23 g of the CELVOL® 203 polymer solution of Example 2, 7.39 g of the borax solution, and 5.38 g of deionized water, using a wet coating gap of 3.5 mils. The resulting under-layer coating had 4 wt % solids and a weight ratio of borax to polymer of 66:33. The dry under-layer coating weight was 0.88 $g/m^2$.

Preparation of Image-Receiving Layer Coated Film

An image-receiving layer coating mix was prepared according to the procedure of Example 3. This mix was knife-coated at room temperature onto the under-layer coated substrate, using a coating gap of 12 mils. The coated film was dried at 85° C. in a Blue M Oven. The dry image-receiving layer coating weight was 41.5 $g/m^2$.

Evaluation of Coated Film

The coated film was evaluated according to the procedure of Example 2. Results of this evaluation are shown in Table II. Note that all film samples in Table II that had $\alpha$ parameters of $2.01\times10^{-12}$ $m^{12}/g^{6}$ or greater exhibited no mud cracking.

Example 9

Under-layer coating mixes were prepared similar to the procedure of Example 2, using either an EASTMAN AQ29® aqueous sulfonated polyester dispersion or an aqueous mixture of CELVOL® 203 poly(vinyl alcohol). The weight ratio of polymer to borax in all under-layers was targeted to be 67:33.

Under-layers were coated using a 4.5 mil coating gap onto either uncoated ("raw") poly(ethylene terephthalate) (PET) substrates or onto PET substrates having primer and subbing layers ("subbed"), as described in U.S. patent application Ser. No. 13/247,135, filed Sep. 27, 2011, which is hereby incorporated by reference in its entirety. The dry coating weights are indicated in Table III.

Image-receiving coating mixes were prepared similar to the procedure of Example 2, using a 20% solution of boehmite alumina. The pH of the alumina mix was adjusted to 3.25; the boehmite alumina to poly(vinyl alcohol) ratio was 94:6; and no surfactant was used. Image-receiving layers were coated using either 12 mil or 14 mil coating gaps. The dry coating weighs are indicated in Table III.

The mud-cracking of each coated film was visually assessed. Film haze (%) was measured in accord with ASTM D 1003 by conventional means using a HAZE-GARD PLUS Hazemeter (BYK-Gardner, Columbia, Md.).

As shown in Table III, the transparent coated films prepared using the sulfonated polyester under-layers exhibited worse mud-cracking and haze than similar films prepared using the poly(vinyl alcohol) under-layers. The only films that exhibited no mud-cracking were films comprising poly (vinyl alcohol).

Note that films in Table III containing poly(vinyl alcohol) and having $\alpha$ parameters of at least $2.01\times10^{-12}$ $m^{12}/g^{6}$ exhibited no mud cracking.

The invention has been described in detail with reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

TABLE I

| ID | Image-Receiving Layer Coating Weight (g/sq. m) | Under-Layer Coating Weight (g/sq. m) | Under-Layer Borax to Polymer Ratio | Under-Layer Borax Coverage (g/sq. m) | Parameter α ($m^{12}/g^6$) | Mud Cracking? |
|---|---|---|---|---|---|---|
| 1-1 | 29.7 | 0.26 | 50:50 | 0.1300 | $6.38 \times 10^{-12}$ | No |
| 1-2 | 38.1 | 0.26 | 50:50 | 0.1300 | $1.12 \times 10^{-12}$ | Yes |
| 1-3 | 38.1 | 0.77 | 66:33 | 0.5133 | $4.40 \times 10^{-12}$ | No |
| 1-4 | 45.1 | 0.73 | 66:33 | 0.4867 | $1.28 \times 10^{-12}$ | Yes |
| 1-5 | 45.1 | 0.58 | 80:20 | 0.4640 | $1.22 \times 10^{-12}$ | Yes |
| 1-6 | 45.1 | 0.79 | 86:14 | 0.6771 | $1.78 \times 10^{-12}$ | Yes |
| 1-7 | 45.1 | 0.99 | 75:25 | 0.7425 | $1.96 \times 10^{-12}$ | Yes |
| 1-8 | 45.1 | 1.4 | 80:20 | 0.9920 | $2.61 \times 10^{-12}$ | No |
| 1-9 | 45.1 | 1.6 | 67:33 | 1.067 | $2.81 \times 10^{-12}$ | No |

TABLE II

| ID | Image-Recving Layer Coating Weight ($g/m^2$) | Under-Layer Coating Weight ($g/m^2$) | Under-Layer Borax Cvg. ($g/m^2$) | Surfactant in Image Recving Layer? | Haze (%) | Wet-ness Value | $\alpha \times 10^{12}$ ($m^{12}/g^6$) | Mud Cracking? |
|---|---|---|---|---|---|---|---|---|
| 2 | 41.5 | 0.64 | 0.427 | No | 19.9 | 1.00 | 2.01 | No |
| 3 | 41.5 | 0.64 | 0.427 | Yes | 22.9 | 0.50 | 2.01 | No |
| 4 | 41.5 | 1.01 | 0.673 | Yes | 22.2 | 0.25 | 3.18 | No |
| 5 | 41.5 | 0.64 | 0.427 | No | 18.9 | 1.00 | 2.01 | No |
| 6 | 41.5 | 0.64 | 0.427 | Yes | 23.1 | 0.50 | 2.01 | No |
| 7 | 41.5 | 0.76 | 0.506 | Yes | 24.1 | 1.00* | 2.39 | No |
| 8 | 41.5 | 0.88 | 0.586 | Yes | 24.2 | 0.25 | 2.76 | No |

*Sample 7 had surface streaks after printing, making the wetness value questionable.

TABLE III

| Under Layer Resin | Substrt. Type | Under-Layer Dry Coating Weight ($g/m^2$) | Under-Layer Borate Dry Coverage ($g/m^2$) | Image-Receiving Layer Dry Coating Weight ($g/m^2$) | Haze (%) | $\alpha \times 10^{12}$ ($m^{12}/g^6$) | Visual Appearance |
|---|---|---|---|---|---|---|---|
| CELVOL | Raw | 1.57 | 1.05 | 46.9 | 18.5 | 2.11 | No Mud Cracking |
| AQ | Raw | 1.46 | 0.98 | 46.9 | 20.6 | | Poor Appearance |
| CELVOL | Raw | 1.56 | 1.05 | 51.4 | 20.2 | 1.10 | Poor Appearance |
| AQ | Raw | 1.36 | 0.91 | 51.4 | 21.1 | | Very Poor Appearance |
| CELVOL | Subbed | 2.17 | 1.45 | 47.9 | 14.6 | 2.51 | No Mud Cracking |
| AQ | Subbed | 1.44 | 0.96 | 47.9 | 17.1 | | Very Poor Appearance |

What is claimed:

1. A transparent ink-jet recording film comprising:

a substrate;

at least one under-layer disposed on said substrate, said at least one under-layer comprising at least one borate or borate derivative and at least one first water soluble or water dispersible polymer comprising at least one hydroxyl group; and at least one image-receiving layer disposed on said at least one under-layer, said at least one image-receiving layer comprising at least one inorganic particle and at least one second water soluble or water dispersible polymer comprising at least one hydroxyl group, wherein the at least one under-layer has a borate or borate derivative coverage of at least about $2.01 \times 10^{-12}$ $m^{12}/g^6$ times the seventh power of the image-receiving layer coating weight and less than about 3 $g/m^2$.

2. The transparent ink jet recording film according to claim 1, wherein said at least one borate or borate derivative comprises at least one hydrate of sodium tetraborate.

3. The transparent ink-jet recording film according to claim 1, wherein said at least one borate or borate derivative comprises sodium tetraborate decahydrate.

4. The transparent ink-jet recording film according to claim 1, wherein said at least one first water soluble or water dispersible polymer comprises poly(vinyl alcohol).

5. The transparent ink-jet recording film according to claim 1, wherein said at least one second water soluble or water dispersible polymer comprises poly(vinyl alcohol).

6. The transparent ink-jet recording film according to claim 1, wherein said at least one inorganic particle comprises boehmite alumina.

7. The transparent ink-jet recording film according to claim 1, wherein the image-receiving layer further comprises nitric acid.

8. The transparent inkjet recording film according to claim 1 wherein the image-receiving layer coating weight is less than about 54.8 $g/m^2$.

9. The transparent ink-jet recording film according to claim 1, wherein the at least one under-layer has a borate or borate derivative coverage less than about 2 $g/m^2$.

10. The transparent ink-jet recording film according to claim 1, wherein the image receiving layer coating weight is about 41.5 $g/m^2$ and the at least one under-layer has a borate or borate derivative coverage of at least about 0.427 $g/m^2$.

11. The transparent ink-jet recording film according to claim 1, wherein the image receiving layer coating weight is about 45.1 $g/m^2$ and the at least one under-layer has a borate or borate derivative coverage of at least about 0.992 $g/m^2$.

12. The transparent ink-jet recording film according to claim 1, wherein the borate or borate derivative coverage is at least about $2.61\times10^{-12}$ $m^{12}/g^6$ times the seventh power of said image-receiving layer coating weight.

13. The transparent inkjet recording film according to claim 12 wherein the image-receiving layer coating weight is less than about 52.8 g/m2.

* * * * *

UNITED STATES PATENT AND TRADEMARK OFFICE

CERTIFICATE OF CORRECTION

PATENT NO. : 8,470,416 B2
APPLICATION NO. : 13/290185
DATED : June 25, 2013
INVENTOR(S) : Sharon M. Simpson et al.

It is certified that error appears in the above-identified patent and that said Letters Patent is hereby corrected as shown below:

In the Specification

Column 9, Line 50 Please replace "a" with --α--

Signed and Sealed this
Eighteenth Day of March, 2014

Michelle K. Lee

Michelle K. Lee
*Deputy Director of the United States Patent and Trademark Office*